US009303475B2

(12) United States Patent
Hart et al.

(10) Patent No.: US 9,303,475 B2
(45) Date of Patent: Apr. 5, 2016

(54) TOOL WITH MULTISIZE SEGMENTED RING SEAT

(75) Inventors: Daniel R. Hart, Sugar Land, TX (US); Gregory L. Hern, Porter, TX (US); Christopher W. Guidry, Spring, TX (US); Robert S. O'Brien, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 583 days.

(21) Appl. No.: 13/469,852

(22) Filed: May 11, 2012

(65) Prior Publication Data

US 2012/0227973 A1 Sep. 13, 2012

Related U.S. Application Data

(63) Continuation-in-part of application No. 12/860,985, filed on Aug. 23, 2010, now Pat. No. 8,356,671, which is a continuation-in-part of application No. 12/826,020, filed on Jun. 29, 2010, now Pat. No. 8,739,864.

(60) Provisional application No. 61/635,522, filed on Apr. 19, 2012.

(51) Int. Cl.

| | |
|---|---|
| ***E21B 34/14*** | (2006.01) |
| ***E21B 21/10*** | (2006.01) |
| ***E21B 23/00*** | (2006.01) |
| *E21B 34/06* | (2006.01) |

(52) U.S. Cl.

CPC ..... *E21B 21/103* (2013.01); *E21B 23/006* (2013.01); *E21B 34/14* (2013.01); *E21B 34/063* (2013.01)

(58) Field of Classification Search

CPC ..... E21B 33/14; E21B 33/063
USPC ..... 166/318, 193, 317
See application file for complete search history.

(56) References Cited

U.S. PATENT DOCUMENTS

| | | | | |
|---|---|---|---|---|
| 4,510,994 | A * | 4/1985 | Pringle | 166/156 |
| 4,889,199 | A | 12/1989 | Lee | |
| 5,499,687 | A | 3/1996 | Lee | |
| 6,412,614 | B1 * | 7/2002 | Lagrange et al. | 188/281 |
| 6,634,428 | B2 * | 10/2003 | Krauss et al. | 166/317 |
| 7,281,584 | B2 | 10/2007 | McGarian et al. | |
| 7,416,029 | B2 | 8/2008 | Telfer et al. | |
| 7,464,764 | B2 | 12/2008 | Xu | |
| 7,628,210 | B2 | 12/2009 | Avant et al. | |
| 7,637,323 | B2 | 12/2009 | Schasteen et al. | |
| 7,644,772 | B2 | 1/2010 | Avant et al. | |
| 8,245,788 | B2 * | 8/2012 | Garcia et al. | 166/373 |
| 8,356,671 | B2 * | 1/2013 | Guillory et al. | 166/318 |
| 8,479,822 | B2 * | 7/2013 | Hofman et al. | 166/318 |

(Continued)

FOREIGN PATENT DOCUMENTS

WO 2012027135 A2 3/2012

*Primary Examiner* — Giovanna C Wright
(74) *Attorney, Agent, or Firm* — Shawn Hunter

(57) ABSTRACT

A wellbore tool which includes a housing having an axial flowbore and a piston sleeve movably disposed within the flowbore. The tool is moveable between first and second operating positions by an actuation mechanism having a piston with a seat having a plurality of separate arcuate segments. The tool can be moved between first and second operating positions with the use of actuating plugs of different sizes that can be landed upon the seat.

14 Claims, 13 Drawing Sheets

(56) References Cited

U.S. PATENT DOCUMENTS

| | | | | |
|---|---|---|---|---|
| 8,636,073 | B2 * | 1/2014 | McNeilly | 166/386 |
| 8,739,864 | B2 * | 6/2014 | Crider et al. | 166/240 |
| 2003/0024706 | A1 * | 2/2003 | Allamon | 166/373 |
| 2007/0107944 | A1 * | 5/2007 | Lee | 175/317 |
| 2009/0308588 | A1 * | 12/2009 | Howell et al. | 166/66.4 |
| 2011/0232915 | A1 * | 9/2011 | Kellner et al. | 166/373 |
| 2011/0278017 | A1 | 11/2011 | Themig et al. | |
| 2012/0043093 | A1 | 2/2012 | Cravatte | |

* cited by examiner

TOOL WITH MULTISIZE SEGMENTED RING SEAT

This application is a continuation-in-part of U.S. patent application Ser. No. 12/860,985 filed Aug. 23, 2010, now U.S. Pat. No. 8,356,671 which was a continuation-in-part of U.S. patent application Ser. No. 12/826,020 filed Jun. 29, 2010, now U.S. Pat. No. 8,739,864. This application also claims priority to U.S. Provisional Patent Application Ser. No. 61/635,522 filed Apr. 19, 2012.

BACKGROUND OF THE INVENTION

1. Field of the Invention

The invention relates generally to circulation valves and sliding sleeve tools. In particular aspects, the invention relates to the design of plug seats used in actuation mechanisms for such tools.

2. Description of the Related Art

Wellbore tools have been designed which are operated by the use of a ball or plug that is landed on a seat within the flowbore of the tool string. The ball or plug serves to increase pressure and/or redirect fluid flow through the tool in order to operate the tool. Tools of this type include circulation valves which are used to selectively open and close lateral fluid flow ports in a tool sub to permit fluid flowing axially through the tool to be diverted into the surrounding flowbore. Circulation valves of this type are described in U.S. Pat. No. 4,889,199 issued to Lee, U.S. Pat. No. 5,499,687 issued to Lee, U.S. Pat. No. 7,281,584 issued to McGarian et al. and U.S. Pat. No. 7,416,029 issued to Telfer et al.

The parent application to this one describes tools which operate by using balls or plugs and having a plug capture and release mechanism that incorporates a C-ring style seat. The parent application to this one is U.S. patent application Ser. No. 12/860,985 filed Aug. 23, 2010, which is incorporated by reference in its entirety.

SUMMARY OF THE INVENTION

The invention provides plug capture and release mechanisms that incorporate plug seats having rings of unconnected segments that are radially expandable within various chamber portions of an expansion chamber in order to permit balls or plugs of different sizes to be passed through the seat. The configuration of the seat permits the ball seat to be reused. In described embodiments, the seat is made up of a plurality of separate arcuate retaining segments that collectively form an annular seat which presents an upper seating surface.

In some embodiments, the seat allows for a degree of flow through the seat when the ball or plug is seated on the seat. In a described embodiment, at least some neighboring segments of the seat have different sized interior diameters from other segments. When a plug is seated on the seat, the plug is seated on the segments that present a smaller interior diameter. Some amount of fluid can flow past the seat through the spaces provided between the plug and the segments having larger interior diameters. This feature allows fluid at a low flow rate to pass through the seat even after a plug is initially landed on the seat. As a result, the circulation valve or other tool within which the seat is used will not shift open or closed prematurely. In described embodiments, a follower and spring are used to stabilize the seat segments.

In another described embodiment, the retaining segments of the seat are formed at the distal ends of a plurality of collets that extend axially from a base ring. The use of collets and a base ring provides stability and prevents the segments of the seat from rotation that might result in them being dislodged from their positions.

Plug seats constructed in accordance with the present invention can expand radially outwardly to conform to a surrounding enclosure. In operation, a plug is seated upon the seat, and fluid pressure can be built up against the plug and seat. When the seat is moved into an enclosure having a larger inner radius, the seat is expanded radially. The retaining segments are spread apart from each other so that the gaps between them become greater. Conversely, when the seat is moved into an enclosure having a smaller inner radius, the seat contracts radially. A compression spring applies an axial load to urge the seat toward this contracted position. The retaining segments are moved closer to each other so that the gaps between them shrink. In particular embodiments, the seat is used within an expansion chamber having at least three chamber portions of different inner diameters. The seat is capable, by design, of expanding to conform within each of these three or more chamber portions. As a result, the seat is capable of selectively capturing and releasing plugs of different sizes.

Exemplary circulation valves are described which incorporate seats constructed in accordance with the present invention. The exemplary circulation valves include a substantially cylindrical housing with a central axial flowbore and a piston sleeve movably disposed within the flowbore. The tool includes an outer housing that defines an axial flowbore. Outer lateral flow ports are disposed through the housing. The housing retains a piston sleeve having inner lateral flow ports, and movement of the piston sleeve within the housing will bring the inner flow ports into and out of alignment with the outer flow ports.

In described embodiments, an indexing mechanism is used to control the axial position of the piston sleeve within the housing. This indexing mechanism allows the tool to be cycled alternately between a first operating position, wherein the outer lateral flow ports are closed off to fluid flow, and a second operating position, wherein the outer lateral flow ports are open to fluid flow. In a described embodiment, the indexing mechanism includes an indexing sleeve with a lug pathway inscribed thereupon. Lugs are carried by the housing and are disposed within the lug pathway to move between various positions within the pathway as the piston sleeve is moved axially. The axial position of the piston sleeve is governed by the location of the lugs within the lug pathway.

The tool also features an actuation mechanism that allows the tool to be switched between its first and second operating positions by means of dropped balls or other plugs that are landed onto the seat within the piston sleeve. Increased fluid pressure is used to move the piston sleeve axially downwardly against a biasing force, such as a spring. Downward movement of the piston sleeve moves the seat into an expansion chamber portion of increased diameter. The increased diameter permits the seat to release an actuation plug. The tool requires one size of actuation plug to move the tool from a first operating position to a second operating position and a second size of actuation plug to move the tool from the second operating position back to the first operating position.

During the process of dropping plugs through the bore of the tool, a positive feedback indication can be provided to a surface operator via the resultant fluid pressure in the tool string whereby operation of the tool is confirmed.

BRIEF DESCRIPTION OF THE DRAWINGS

The advantages and further aspects of the invention will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION OF THE PREFERRED EMBODIMENTS

Figure 1:
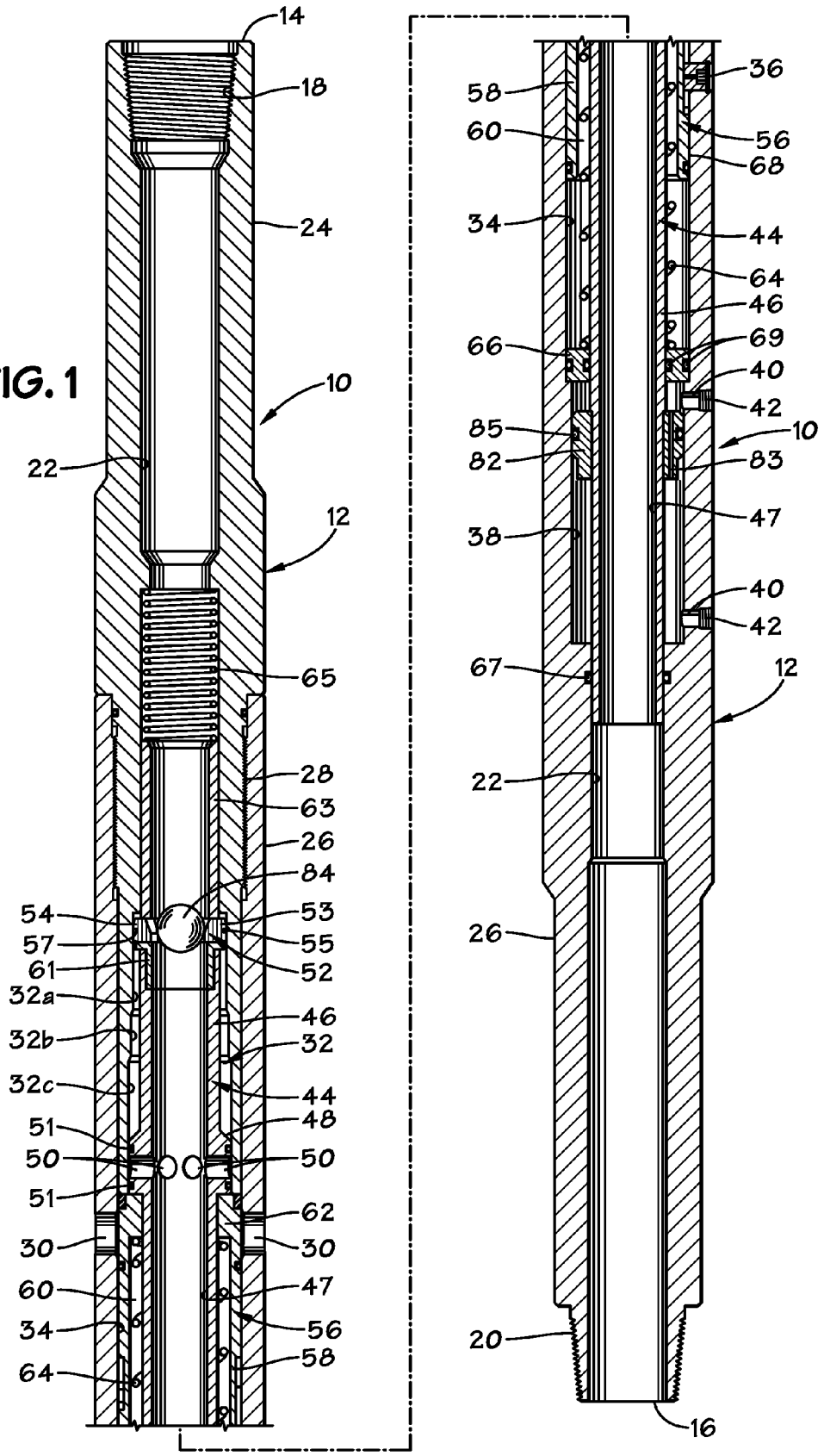
FIG. 1 is a side, cross-sectional view of an exemplary circulation valve tool which includes a seat constructed in accordance with the present invention, the circulation valve tool being in a first operating position.

FIGS. 1, 1A and 2-8 illustrate an exemplary circulation valve tool 10 that is constructed in accordance with the present invention. The upper portion of the tool 10 is shown on the left-hand side of FIGS. 1 and 2-4 while the lower portion of the tool 10 is shown on the right-hand side of FIGS. 1 and 2-4. The circulation valve tool 10 includes a generally cylindrical outer housing 12 that presents an upper axial end 14 and a lower axial end 16. The upper end 14 includes a box-type threaded connection 18, and the lower end 16 provides a pin-type threaded connection 20. The connections 18, 20 are of a type known in the art for incorporating the tool 10 into a tool string (not shown) disposed in a wellbore. The housing 12 defines a central flowbore 22 along its length. In a preferred embodiment, the housing 12 is made up of an upper sub 24 and a lower sub 26 that are threaded together at connection 28. Outer lateral fluid ports 30 are disposed through the housing 12.

Located within the housing 12, and preferably within the lower end of the upper sub 24, is a stepped expansion chamber, generally shown at 32. FIG. 1A depicts this chamber 32 in greater detail. As best seen there, the expansion chamber 32 includes three chamber portions 32*a*, 32*b* and 32*c* having interior diameters that sequentially increase. The small diameter chamber portion 32*a* has the smallest diameter. The large diameter chamber portion 32*c* has the largest diameter. The intermediate diameter chamber portion 32*b* has a diameter that is greater than the small diameter chamber portion 32*a* but is smaller than that of the large diameter chamber portion 32*c*.

An indexing chamber 34 is defined within the housing 12 below the expansion chamber 32. One or more indexing lugs 36 are disposed through the housing and protrude into the indexing chamber 34. Although only a single lug 36 is visible in FIGS. 5-8, it is currently preferred that there be multiple lugs 36 that are angularly spaced about the circumference of the housing 12.

Below the indexing chamber 34, a damping chamber 38 is defined within the housing 12. Lateral fill ports 40 are disposed through the housing 12 and closed off with plugs 42.

A piston sleeve 44 is disposed within the expansion chamber 32. The piston sleeve 44 has a generally cylindrical body 46 which defines a central flow path 47. A flange 48 projects radially outwardly from the body 46 and has inner radial fluid ports 50 disposed within. Annular fluid seals 51 surround the body 46 and seal against the surrounding housing 12, thereby isolating the fluid ports 50.

A plug seat 52 is located within the flowbore 22 and disposed upon the piston sleeve 44. An exemplary seat 52 is depicted in greater detail in FIGS. 9-12. The seat 52 is made up of a plurality of separate arcuate retaining segments 53 and 54. Segments 54 have a larger interior diameter than the segments 53. In the described embodiment, segments 53 and 54 are arranged in an alternating manner such that each segment 53 is adjacent a segment 54 on either side and vice versa.

The seat 52 may be created by first obtaining two annular parent rings, one of which has a larger interior diameter than the other ring. The parent ring with the larger interior diameter will provide the segments 54 while the other parent ring will provide the segments 53. The parent rings are each cut into segments and arranged with segments from the other parent ring to form two seats 52 in accordance with the present invention.

In the depicted embodiment, an O-ring retainer 55 is disposed within a groove 57 that is inscribed within the outer radial surface of the segments 53, 54. The O-ring retainer 55 is useful for keeping the segments 53, 54 in place together during handling and assembly of the tool 10. The outer radial surface of the seat 52 is sized to fit within the small diameter chamber portion 32*a* when the segments 53, 54 are in adjacent contact with each other.

Segments 53 each present an upper, inwardly-facing primary seating surface so that the seat 52 is capable of capturing both a small plug 84 and a larger plug 86. As can be seen by reference to FIGS. 10, 11 and 12, however, the plug is not seated upon the segments 54 while seated on the seat 52. As a result, a gap 59 is shown between the plug 84 and each segment 54.

In the described embodiment, a flanged support sleeve 61 is secured to the upper end of the piston sleeve 44. As can be seen best in FIG. 1A, there is preferably a follower sleeve 63 located above the seat 52. A compression spring 65 biases the follower sleeve 63 downwardly onto the seat 52, this biasing force helping to keep the separate segments 53, 54 of the seat 52 in place against the flanged support sleeve 61 throughout operation.

Figure 2:
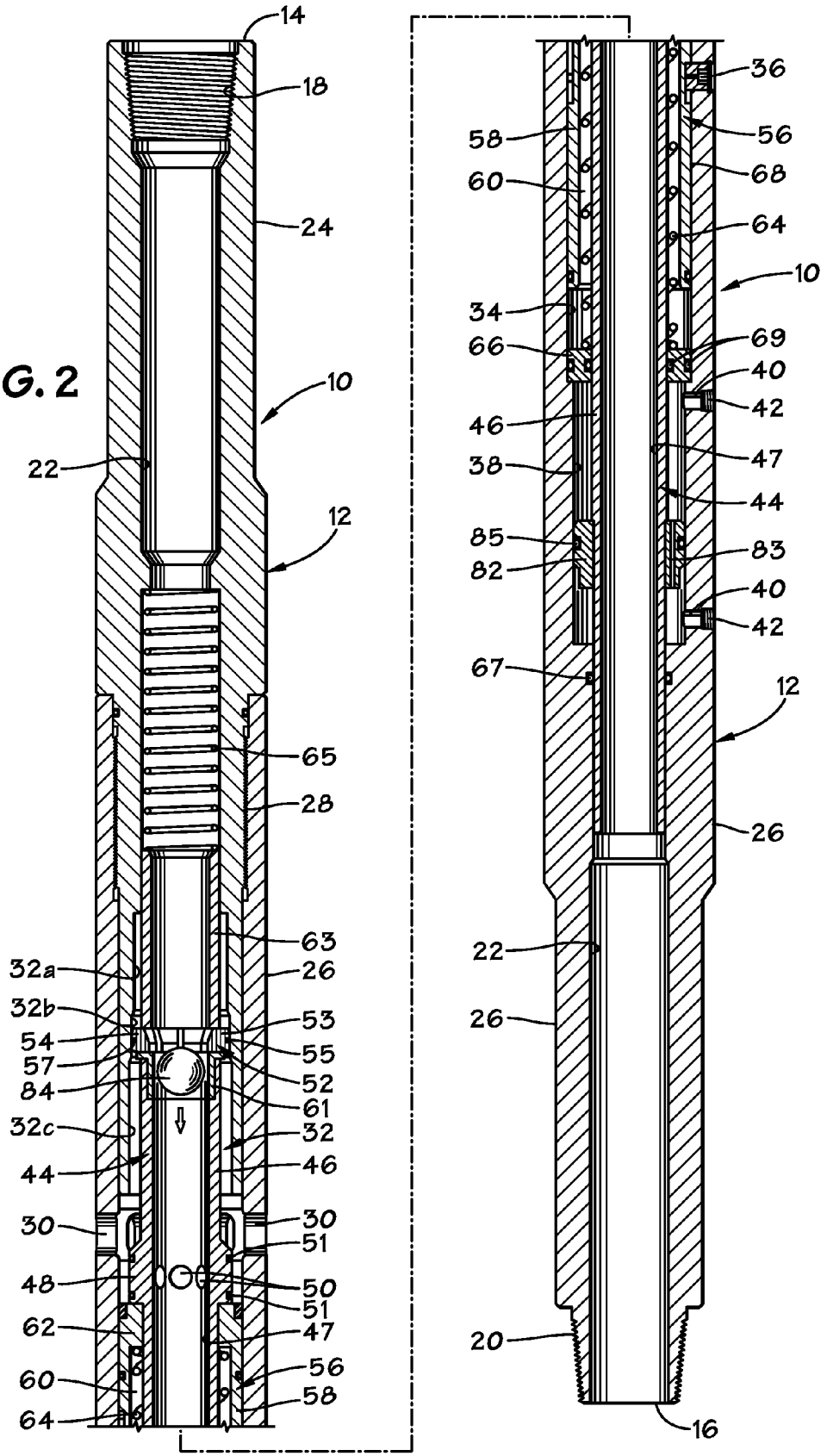
FIG. 2 is a side, cross-sectional view of the tool shown in FIG. 1, now in a first intermediate position.
Figure 3:
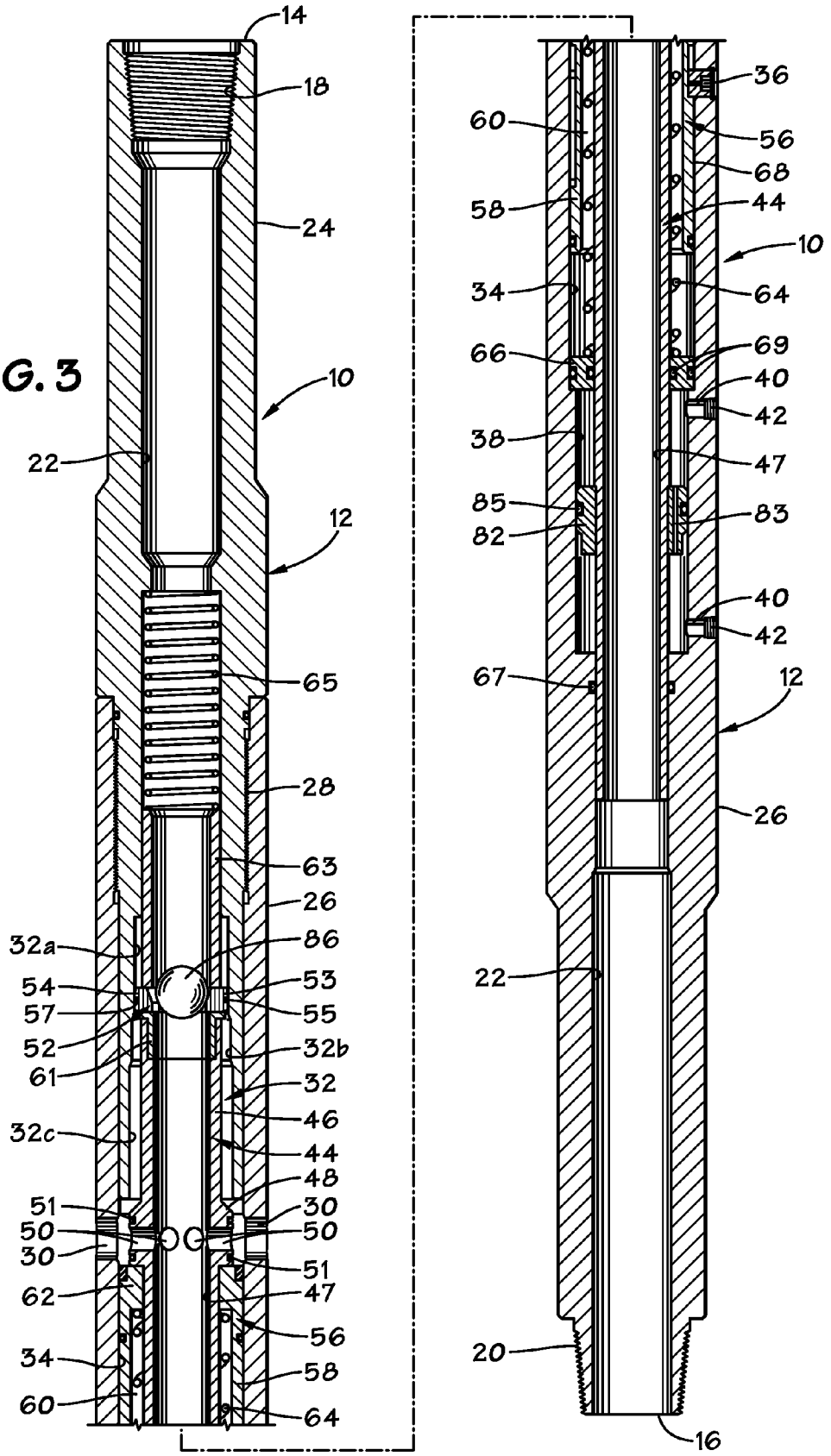
FIG. 3 is a side, cross-sectional view of the tool shown in FIGS. 1-2, now in a second operating position.
Figure 4:
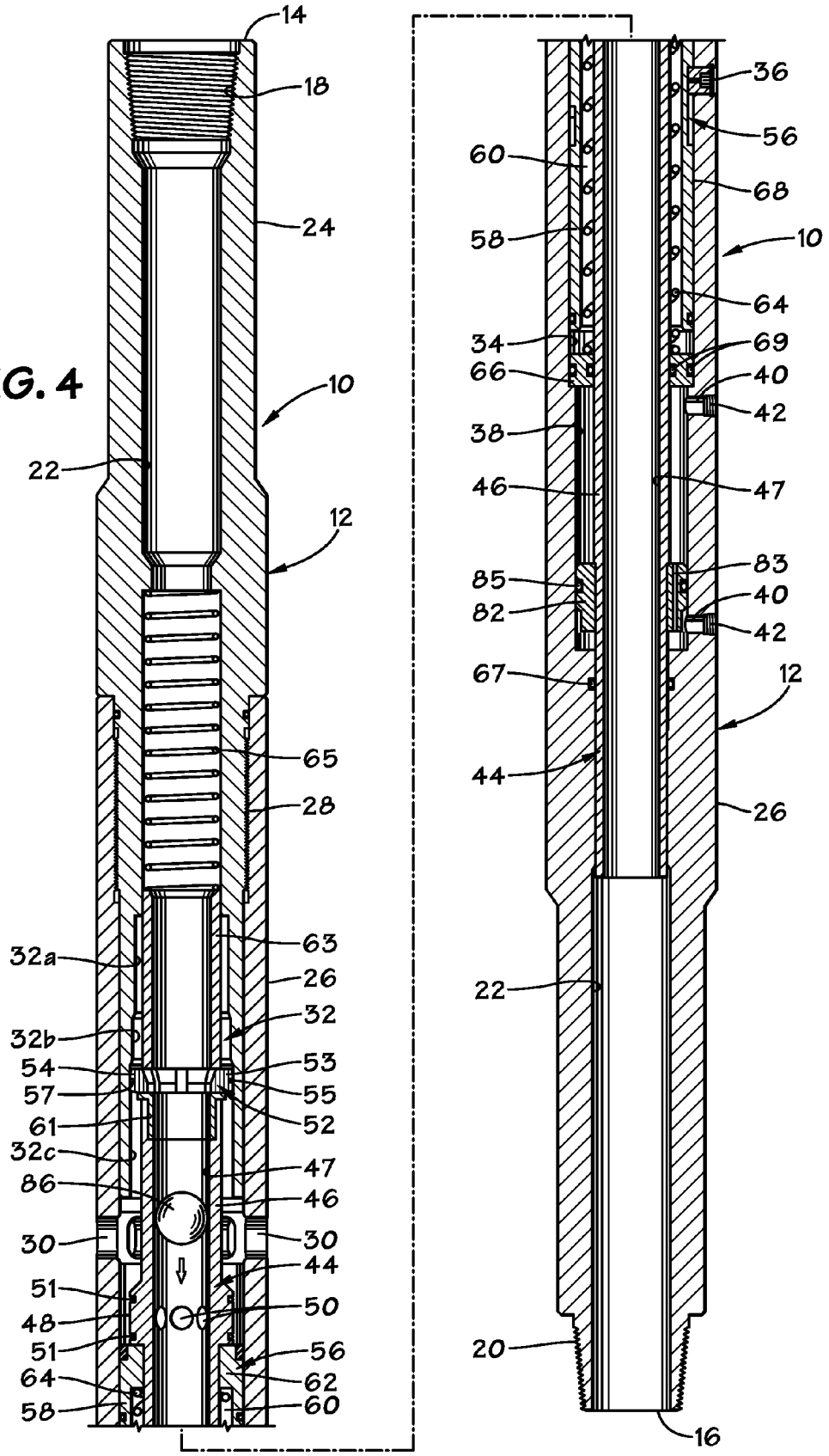
FIG. 4 is a side, cross-sectional view of the tool shown in FIG. 1-3, now in a second intermediate position.

A central opening is defined centrally within the seat 52. FIGS. 9-12 depict the seat 52 in a fully retracted position wherein the central opening is the smallest since the adjacent segments 53, 54 are in contact with one another. FIGS. 2 and 4 depict the seat 52 in expanded configurations wherein the central opening is larger due to the segments 53, 54 being spread apart from each other.

The design of the seat 52 permits balls or other plugs of various sizes to be captured and released. It is noted that the plugs 84 and 86 shown in the drawings are spherical balls. Darts or plugs of other shapes or configurations may also be used. When the seat 52 is located within the small diameter chamber portion 32*a*, the seat 52 is in the fully retracted position and both a smaller actuation plug 84 and a larger actuation plug 86 can be seated upon the seat 52. When the seat 52 is located within the intermediate diameter chamber portion 32*b* (see FIG. 3), the seat 52 will be in a partially enlarged position since the segments 53, 54 are spaced apart from each other within the confines of the intermediate diameter chamber portion 32*b*. As a result, a larger actuation plug 86 will still be captured by the seat 52. However, when the seat 52 is positioned within the intermediate diameter chamber portion 32*b*, the smaller actuation plug 84 will pass through the central opening of the seat 52. When the seat 52 is located within the large diameter chamber portion 32*c*, the seat 52 will be in a further enlarged position and both the smaller plug 84 and the larger plug 86 will pass through the central opening of the seat 52.

An indexing sleeve 56 surrounds a lower portion of the body 46 within the indexing chamber 34 and is moveable within the indexing chamber 34. The indexing sleeve 56 is generally cylindrical and has a radially enlarged skirt portion 58. An annular spring chamber 60 is defined radially between the skirt portion 58 and the body 46 of the piston sleeve 44. The upper end of the indexing sleeve 56 has an inwardly extending flange 62 which engages the body 46. A compression spring 64 surrounds the piston sleeve 44 and resides generally within the spring chamber 60. The upper end of the compression spring 64 abuts the flange 62 while the lower end of the spring 64 abuts an annular plug member 66 which is disposed within the indexing chamber 34 and seals off the indexing chamber 34 from the damping chamber 38. It is noted that an annular fluid seal 67 forms a seal between the lower sub 26 and the piston sleeve 44. Fluid seals 69 are located around and within the plug member 66 to provide sealing against the piston sleeve 44 and the indexing chamber 34.

As can be seen with reference to FIGS. 5-8, the indexing sleeve 56 presents an outer radial surface 68 that has a lug pathway 70 inscribed therein. The lug pathway 70 is shaped and sized to retain the interior ends of each of the lugs 36 within. The lug pathway 70 generally includes a central circumferential path 72. A plurality of legs extends axially away from the central path 72. The pathway 70 is designed such that the number of each type of leg equals the number of lugs 36 that are used with the pathway 70. Long legs 74 and short legs 76 extend axially downwardly from the central path 72. In addition, long legs 78 and short legs 80 extend axially upwardly from the central path 72.

Referring once again to FIGS. 1-4, it is noted that a damping piston 82 is preferably disposed within the damping chamber 38. The damping piston 82 is securely affixed to the piston sleeve 44 and contains one or more restrictive fluid flow orifices 83 which extend entirely through the damping piston 82. Fluid seal 85 radially surrounds the damping piston 82 and forms a fluid seal against the interior wall of the damping chamber 38. A hydraulic fluid fills the damping chamber 38 both above and below the damping piston 82.

The tool 10 can be repeatedly switched between a first operating position, wherein the outer fluid ports 30 are closed against fluid flow, and a second operating position, wherein the outer fluid ports 30 are open to fluid flow. To do this, actuation plugs 84 and 86 are dropped into the flowbore 22 of the tool 10 to cause the tool 10 to be actuated between these positions. Plug 84 is of a smaller size than plug 86. When the tool 10 is initially made up into a tool string and run into a wellbore, it is typically in the first operating position shown in FIG. 1, although plug 84 is not present. The seat 52 is located within the small diameter chamber portion 32*a* of the expansion chamber 32. The lugs 36 are located within the long downwardly extending legs 74 (see FIG. 5). In this position, fluid flow through the lateral fluid ports 30 is closed off by the indexing sleeve 56. The interior fluid flow ports 50 also are not aligned with the outer fluid flow ports 30 and fluid seals 51 prevent fluid communication with the interior ports 50. Fluid can be flowed and tools may be passed axially through the flowbore 22 of the tool 10.

Due to the configuration of the seat 52, an operator can land a plug onto the seat 52 and continue to operate another tool below the circulation valve tool 10 until the tool 10 is later actuated. The smaller plug 84 is dropped into the flowbore 22 where it lands on the seat 52 (see FIGS. 1 and 1A). Fluid pressure can then be increased within the flowbore 22 above the landed plug 84. Due to the presence of the gaps 59 between the plug 84 and the segments 54 of the seat 52, fluid can flow through the seat 52 even after the plug 84 has been landed. Fluid flowing through the valve tool 10 can be used to operate a tool that is below the tool 10 in the tool string. The total flow area of the tool 10 through the gaps 59 should be less than the total flow area below the tool 10 or of any tool below the tool 10 that is going to be operated after landing the plug 84 or 86. It is noted that the total flow area of the tool 10 in this instance can be altered by changing out the segments 54 and replacing them with segments having either a larger or smaller interior diameter. As a result, the size of the gaps 59 will be changed and, thus, the total flow area provided by the tool 10.

This flow-through feature of the seat 52 also permits an operator to safely start his rig pumps without immediate actuation of the tool 10 in the event that a plug 84 or 86 has been inadvertently disposed into the wellbore. Pump flow rate can then be gradually increased to obtain the necessary fluid pressure to actuate the tool 10 in a manner which will be described hereafter.

When it is desired to open the lateral fluid ports 30 to permit fluid communication between the flowbore 22 and the surrounding wellbore, a further increased fluid pressure causes the piston sleeve 44 and affixed indexing sleeve 56 to shift axially downwardly with respect to the housing 12, as depicted in FIG. 2. The compression spring 64 is compressed. The lugs 36 will move along the pathway 70 to become located within the upwardly extending legs 80 of the pathway 70 (see FIG. 6). As this axial movement occurs, the indexing sleeve 56 and the piston sleeve 44 are rotated within the housing 12.

Figure 6:
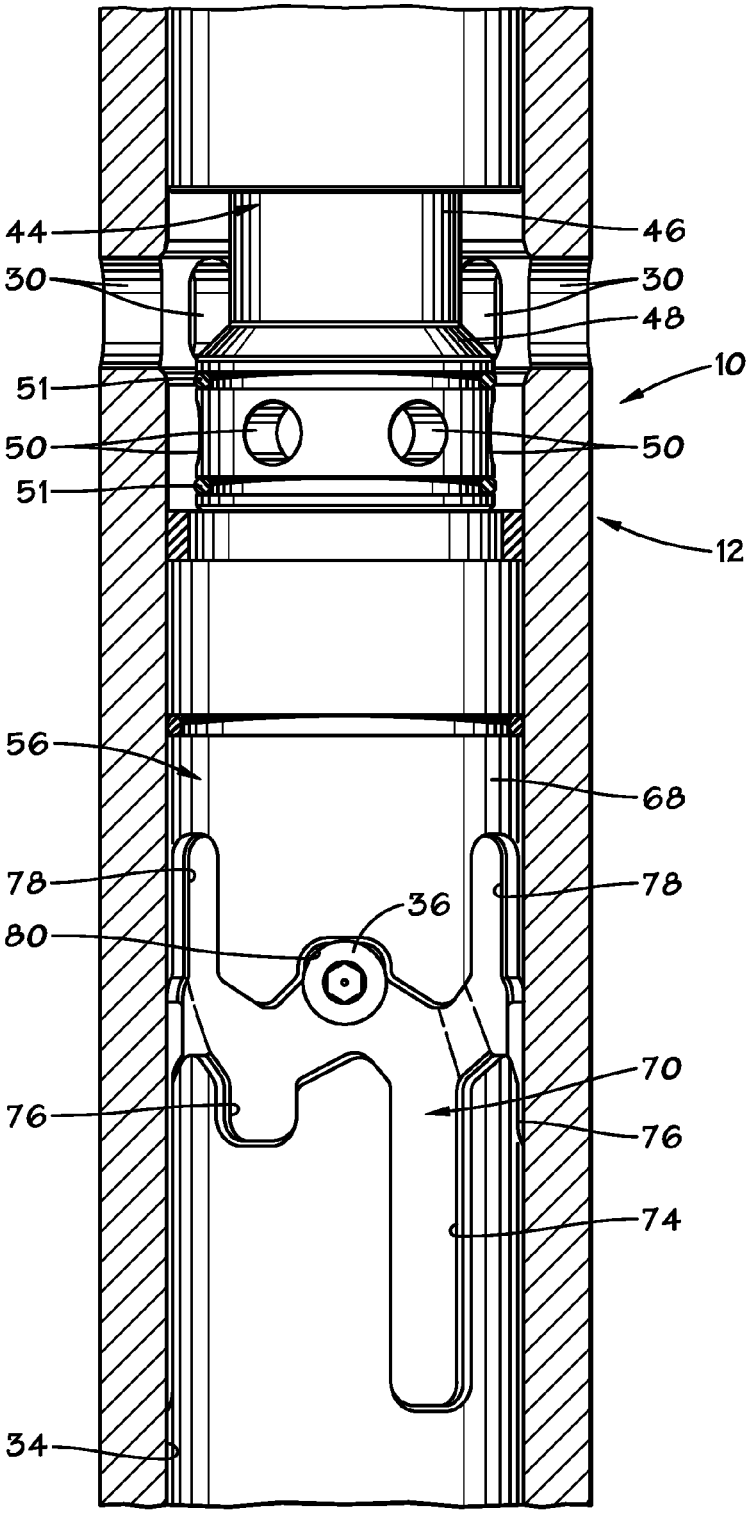
FIG. 6 is an enlarged side, cross-sectional view of the tool portions shown in FIG. 5, now in the first intermediate position.
Figure 7:
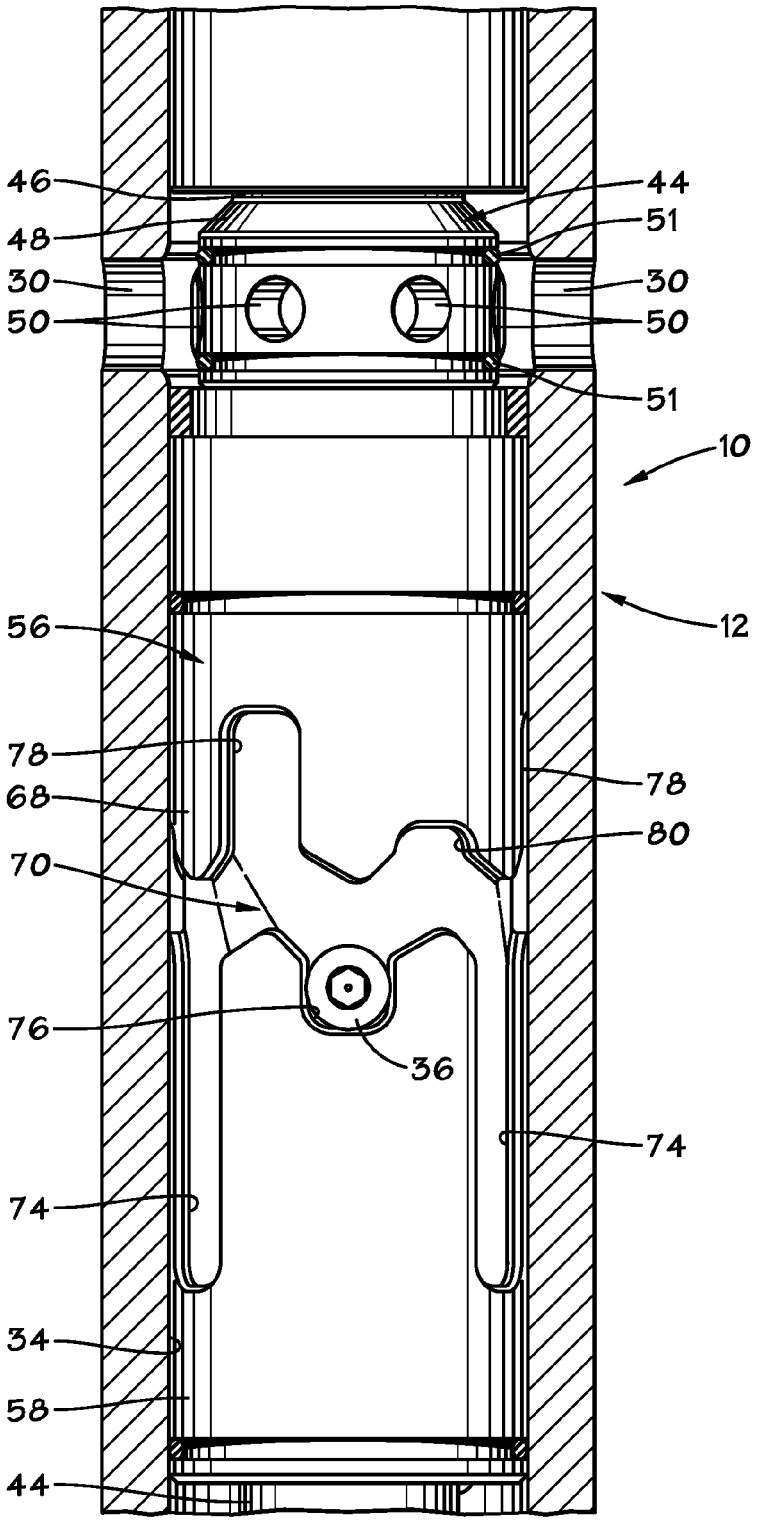
FIG. 7 is an enlarged side, cross-sectional view of the tool portions shown in FIGS. 5 and 6, now in the second operating position.
Figure 8:
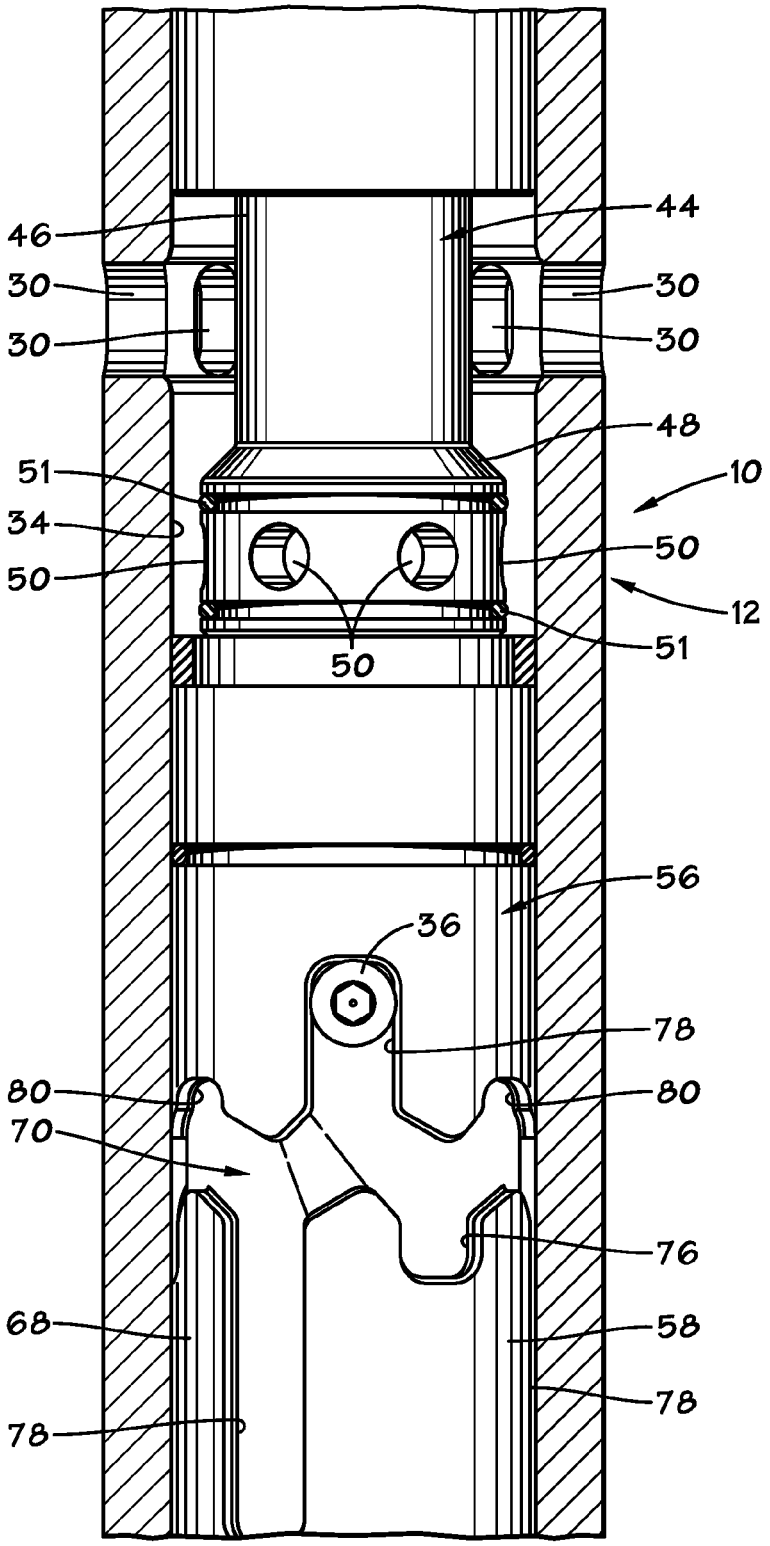
FIG. 8 is an enlarged side, cross-sectional view of the tool portions shown in FIGS. 5-7, now in the second intermediate position.
Figure 9:
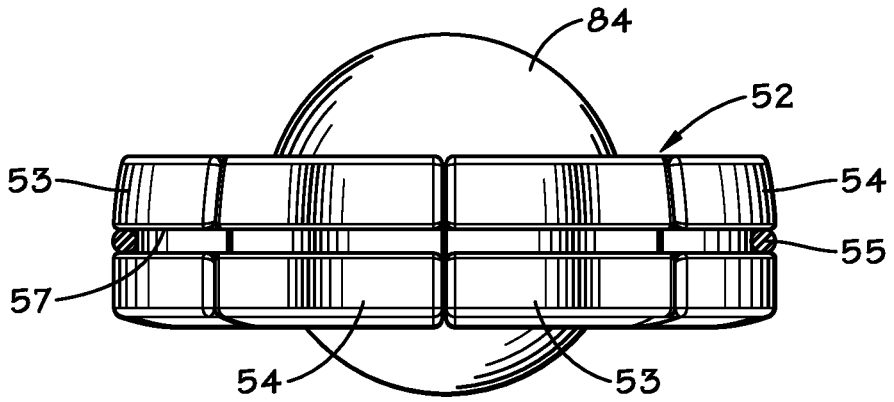
FIG. 9 is a side view of an exemplary seat constructed in accordance with the present invention apart from other components of the circulation sub tool and in a fully contracted position.
Figure 10:
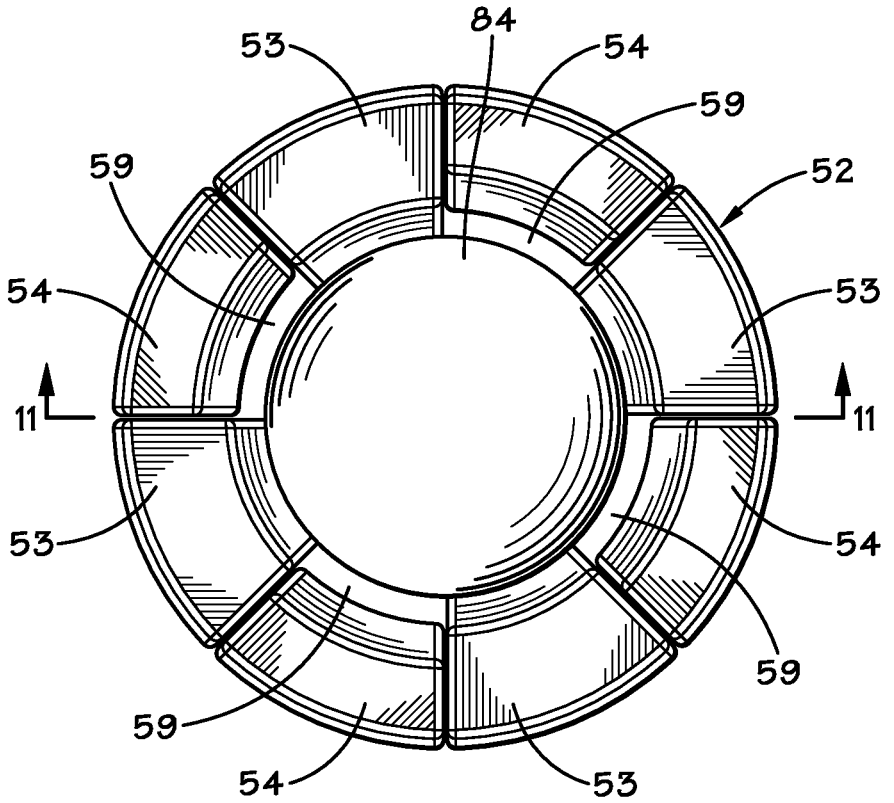
FIG. 10 is a top view of the seat shown in FIG. 9.
Figure 11:
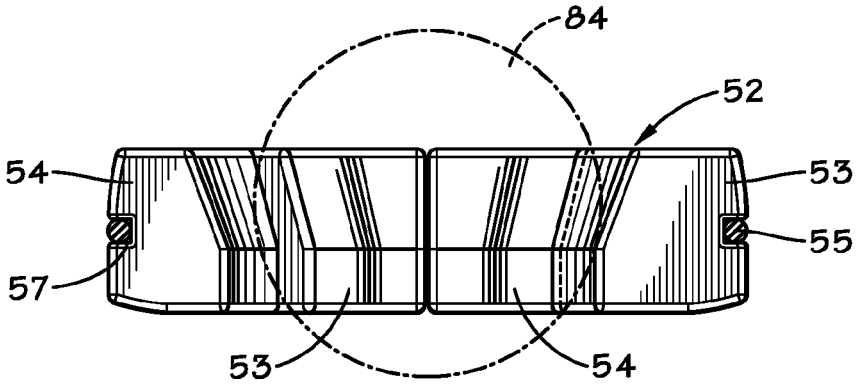
FIG. 11 is cross-sectional view taken along lines 11-11 in FIG. 10.
Figure 12:
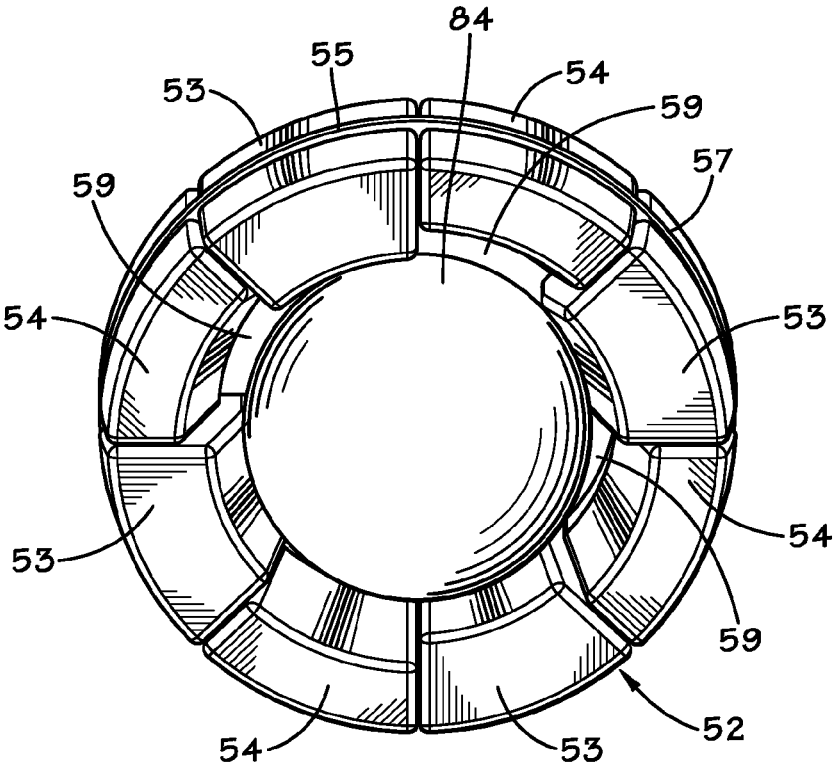
FIG. 12 is an external isometric view of the seat shown in FIGS. 9-11.

As the piston sleeve 44 moves axially downwardly to the first intermediate position depicted in FIGS. 2 and 6, the seat 52 is moved into the intermediate diameter chamber portion 32*b* of the expansion chamber 32. The enlarged diameter of the intermediate diameter chamber portion 32*b* permits the segments 53, 54 of the seat 52 to expand apart from each other and release the small plug 84, as shown. The lugs 36 will shoulder out in the short, upwardly-extending legs 80 of the lug pathway 70 when the seat 52 is in position to release the plug 84. The released plug 84 may be captured by a ball catcher (not shown) of a type known in the art, which is located within the tool string below the tool 10.

After the plug 84 has been released from the seat 52, the spring 64 will urge the piston sleeve 44 and indexing sleeve 56 axially upwardly within the housing 12. Upward movement of the piston sleeve 44 and indexing sleeve 56 will end when the lugs 36 shoulder out in the short downwardly extending legs 76 of the lug pathway 70. The tool 10 will now be in the second operating position depicted in FIGS. 3 and 7. In this operating position, the inner fluid flow ports 50 of the piston sleeve 44 are aligned with the outer fluid flow ports 30 of the housing 12 so that fluid may flow between the inner flowbore 22 and the surrounding wellbore. It is also noted that the seat 52 is now once more located radially within the small diameter chamber portion 32*a* of the expansion chamber 32.

Figure 1A:
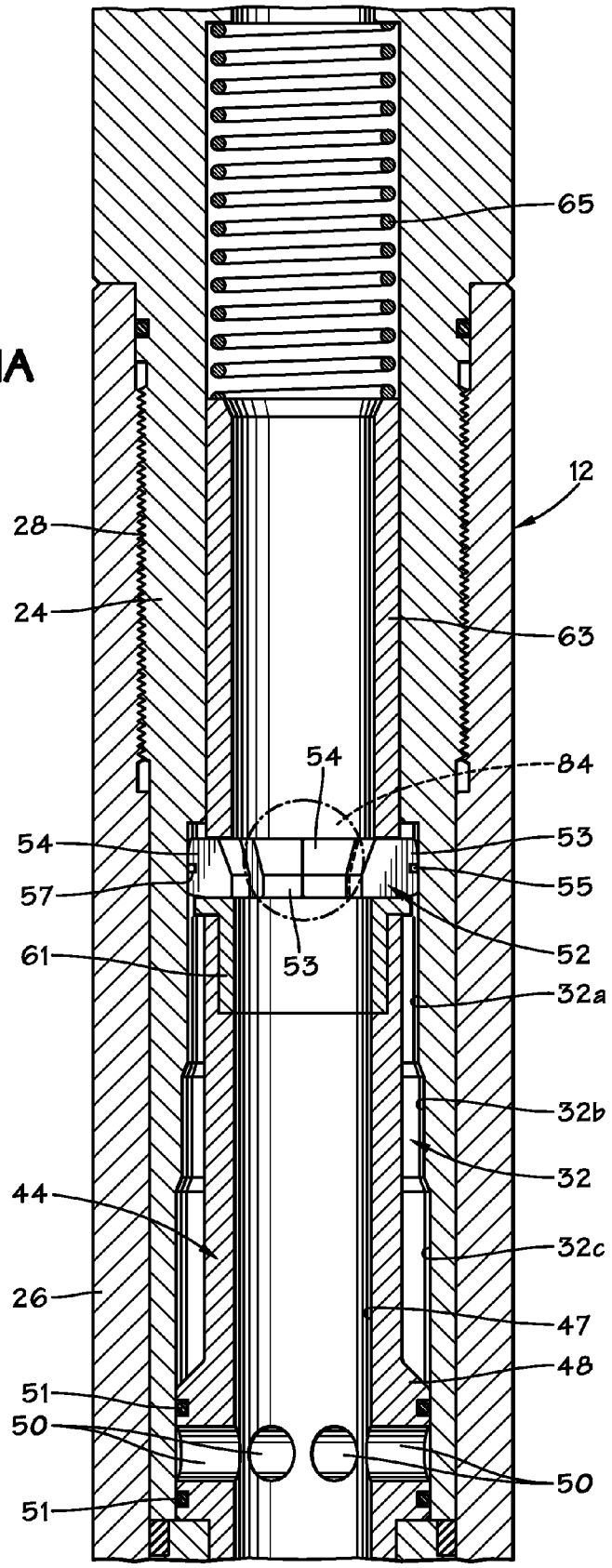
FIG. 1A is an enlarged cross-sectional view of portions of the seat of the tool shown in FIG. 1.
Figure 5:
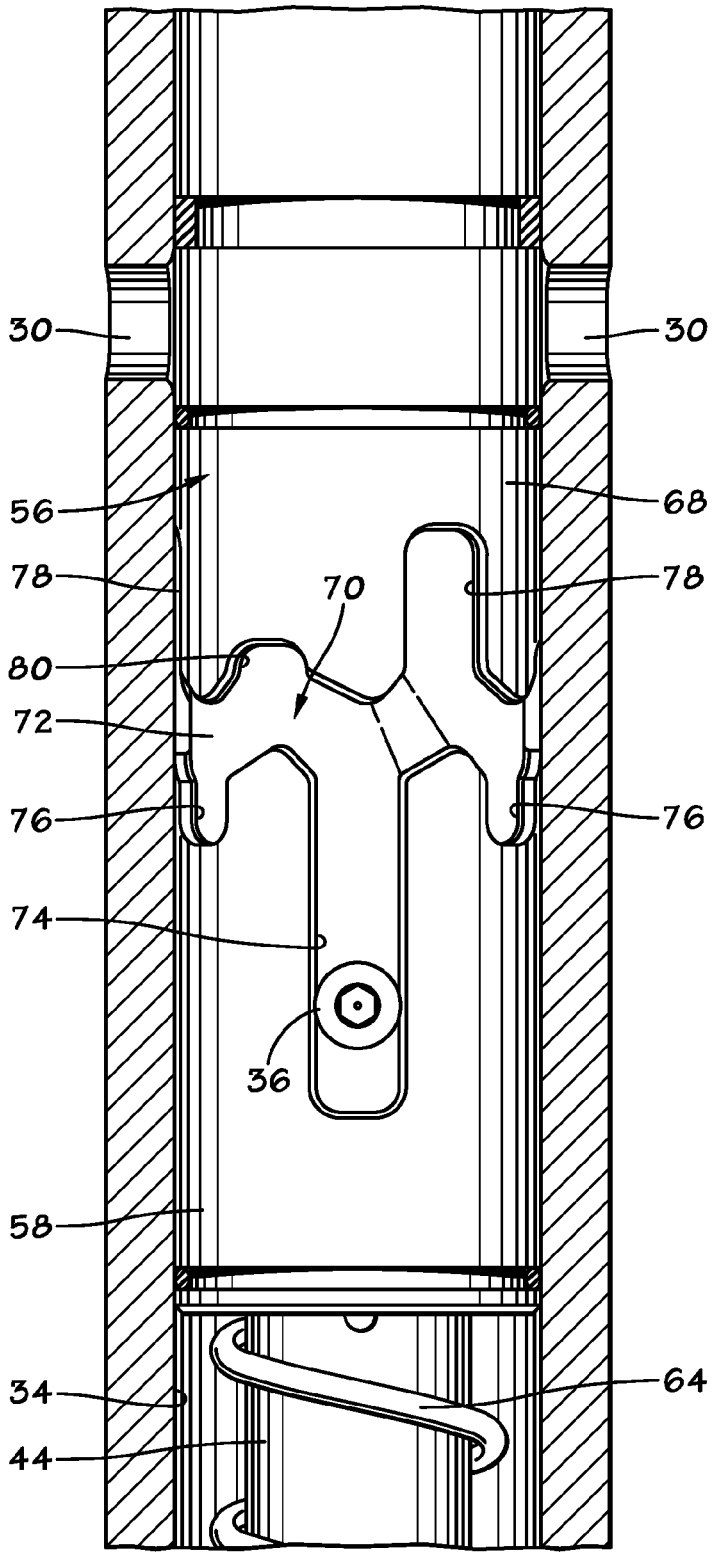
FIG. 5 is an enlarged side, cross-sectional view of portions of the tool shown in FIG. 4, now in the first operating position.

When it is desired to return the tool 10 to the first (closed) operating position depicted in FIGS. 1 and 5, the larger plug 86 is dropped into the flowbore 22 and landed upon the seat 52. Fluid pressure is then increased within the flowbore 22 above the plug 86. The increased fluid pressure will urge the piston sleeve 44 and indexing sleeve 56 axially downwardly within the housing 12 and compress the spring 64. The tool 10 is now in the second intermediate position depicted by FIG. 4. The lugs 36 are moved into the upwardly extending long legs 78 of the lug pathway 70 (see FIG. 8). As a result, the seat 52 is moved downwardly into the large diameter chamber portion 32*c* of the expansion chamber 32, thereby allowing the central opening of the seat 52 to be enlarged adequately to allow the larger plug 86 to be released from the seat 52.

As the larger plug 86 is released from the seat 52, the spring 64 will urge the piston sleeve 44 and the indexing sleeve 56 axially upwardly once more and return the tool to the first operating position illustrated in FIGS. 1 and 5. From this first operating position, it can once more be switched to the second operating position (FIGS. 3 and 7) and back again by repeating the above-described steps. It is noted that the tool 10 can be repeatedly switched between the first and second operating positions by the sequential use of a smaller plug 84 followed by a larger plug 86. Those of skill in the art will understand that, because the lug pathway 70 surrounds the indexing sleeve 56 in a continuous manner, the above-described steps may be repeated to cycle the tool 10 between operating positions.

Only a smaller plug 84 will be useful to move the tool 10 from the first (closed) operating position to the second (open) operating position. If a large plug 86 were landed on the seat 52 when the tool 10 is in the first operating position (FIGS. 1 and 5), the large plug 86 would not be released from the seat 52 when the seat 52 is moved downwardly into the intermediate diameter chamber portion 32*b* (FIG. 2). The lugs 36 will shoulder out in the legs 80 of the lug pathway 70 (FIG. 6). Pressure within the flowbore 22 will have to be reduced to permit the tool 10 to move to the position depicted in FIGS. 3 and 7. Thereafter, the fluid pressure once again can be varied and increased within the flowbore 22, which will move the tool 10 to the second intermediate position shown in FIGS. 4 and 8, and the larger plug 86 will be released as the seat 52 is moved into the large diameter chamber portion 32*c*.

Conversely, only a larger plug 86 will be useful to move the tool 10 from the second (open) operating position to the first (closed) operating position. If a smaller plug 84 was to be dropped with intentions that it be landed on the seat 52 when the tool 10 is in the second operating position (FIGS. 3 and 7), it would pass through the central opening of the seat 52 once the seat 52 became located within the intermediate diameter chamber portion 32*b*. As a result, with the smaller plug 84, the tool 10 is incapable of being moved to the second intermediate position (FIGS. 4 and 8) because it will release the smaller plug 84 before the tool can reach the second intermediate position.

During the movements of the piston sleeve 44 and indexing sleeve 56 described above, a damping assembly, which includes the damping chamber 38 and the damping piston 82, controls the relative velocity of these components within the housing 12. For example, as the piston sleeve 44 is moved axially downwardly within the housing 12 (as it would when moving from the position shown in FIG. 1 to the position shown in FIG. 2), the affixed damping piston 82 will be urged downwardly within the damping chamber 38. Fluid below the damping piston 82 within the damping chamber 38 must be transferred across the damping piston 82 through the orifice 83 in order to accommodate the damping piston 82. This fluid transfer requires some time to elapse because the orifice 83 is restrictive. Therefore, the rate of movement of the damping piston 82 and the affixed piston sleeve 44 is slowed.

It should be understood that the tool 10 provides an actuation mechanism that presents a seat 52 that will release different sized plugs 84 and 86 when the tool 10 is shifted from each of two operating positions. It is also noted that the tool 10 is operated using actuating plugs 84 and 86 that are of different sizes. Only the large plug 86 can close the tool 10, and only the small plug 84 can open the tool 10. As a result, it is easy for an operator to keep track of the internal positions of the tool 10. This feature helps ensure that unintended return of the tool 10 to its first operating position does not occur. This is because a smaller plug 84 will be released by the seat 52 before it moves the indexing sleeve 56 to the first operating position, and only the use of a larger plug 86 will function to return the tool 10 to its first operating position.

Figure 14:
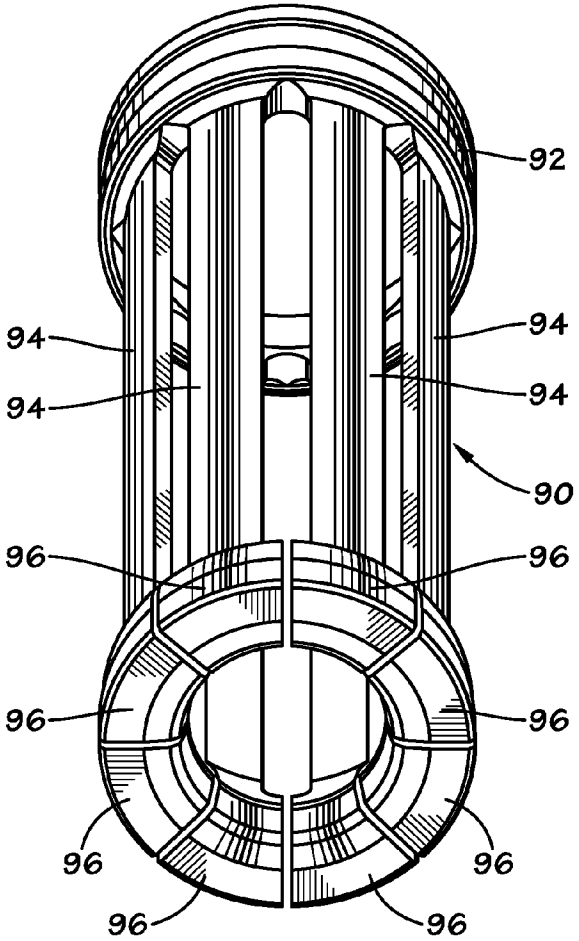
FIG. 14 is another isometric view of the seat shown in FIG. 13.
Figure 13:
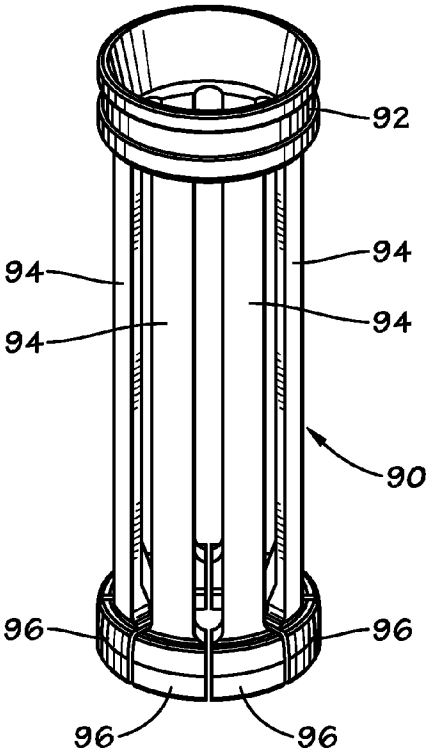
FIG. 13 is an isometric view of an alternative seat constructed in accordance with the present invention.
Figure 15:
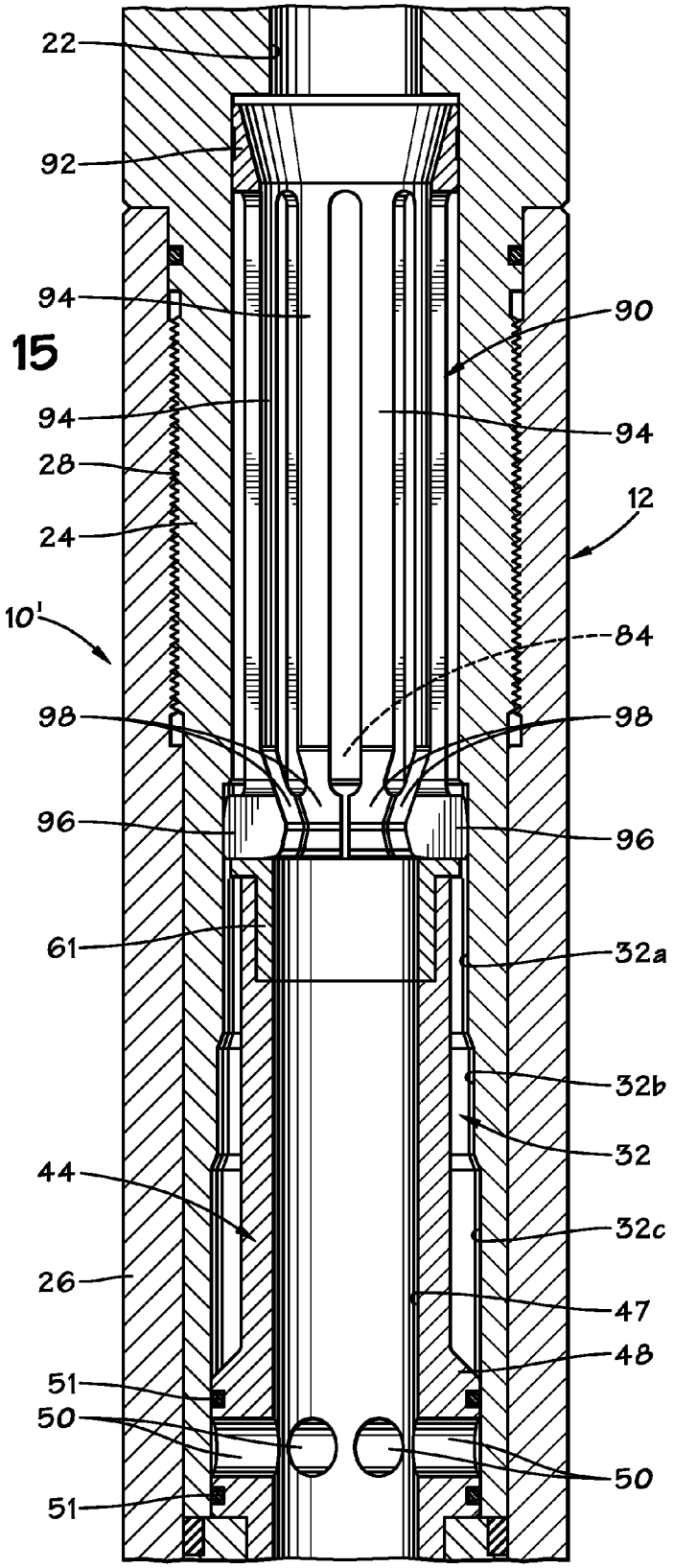
FIG. 15 is a side, cross-sectional view of portions of an exemplary alternative circulation valve tool which includes the seat of FIGS. 13 and 14.

FIGS. 13-15 depict an alternative plug seat 90 that can be incorporated within an alternative circulation valve tool 10'. FIGS. 13-14 show the seat 90 apart from the other components of the tool 10'. FIG. 15 shows the seat 90 within the circulation valve tool 10'. The exemplary seat 90 includes a base ring 92 with a plurality of collets 94 that extend axially therefrom. An arcuate segment 96 is formed at the distal end of each collet 94. The arcuate segments 96 each present an inwardly and upwardly directed seating surface 98 (see FIG. 15) upon which a plug 84 or 86 can be seated.

When the arcuate segments are located in the different sized chamber portions 32*a*, 32*b* and 32*c*, they can be expanded apart from one another or moved closer to one another, in the same manner as described previously with respect to seat 52, as plugs 84 or 86 are seated. Plugs 84 or 86 are landed by disposing them into the flowbore of the running string and into the flowbore 22 of the housing 12. The plug 84 or 86 will pass through the base ring 92 and land upon the seating surfaces 98 of the arcuate segments 96. The use of collets 94 and the base ring 92 to retain the arcuate segments 96 provides stability for the arcuate segments 96 and prevents them from rotating during operation and possibly becoming dislodged.

In certain embodiments, some of the segments 96 present an interior diameter that is larger than the diameter of one or more neighboring segments 96, thus providing the flow-through feature described above.

It should be understood that the invention provides plug catch-and-release mechanisms that are useful within hydraulically actuated tools, such as tools 10 and 10' that are used in relation to subterranean hydrocarbon production. In particular exemplary embodiments, the catch-and-release mechanisms include the expansion chamber 32 of the tools 10, 10' as well as the seats 52 and 90 which permit plugs 84 and 86 to be selectively caught and released.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention.

What is claimed is:

1. A catch-and-release mechanism for use in a subterranean hydrocarbon production-related tool that is hydraulically actuated, the catch-and-release mechanism comprising:

an expansion chamber defined within the tool and having a plurality of chamber portions of different diameters;

a seat to catch and release a plug, the seat being retained within the expansion chamber and formed of a plurality of separate arcuate segments which define an annular seat having a central opening;

wherein the central opening of the seat has a first diameter when the seat resides within one of said plurality of chamber portions and a second diameter that is larger than the first diameter when the ball seat resides within another of said chamber portions; and wherein at least one of said arcuate segments has a larger interior diameter than at least another of said arcuate segments, thereby allowing fluid to flow through the seat when a plug is seated on the seat.

2. The catch-and-release mechanism of claim 1 wherein the seat is seated upon a piston sleeve that is axially moveable within a housing of the tool and wherein axial movement of the piston sleeve within the housing causes the tool to change operating positions.

3. The catch-and-release mechanism of claim 2 wherein the tool may be repeatedly cycled between operating positions.

4. The catch-and-release mechanism of claim 1 wherein there are three chamber portions and wherein the central opening has a third diameter when the seat resides within a third chamber portion.

5. A tool for use in subterranean hydrocarbon production comprising:

a housing defining an axial flowbore and having an outer lateral fluid port formed therein;

a piston sleeve axially moveably disposed within the flowbore and having an inner lateral fluid port, the piston sleeve being moveable between a first position corresponding to a first operating position for the tool, and a second position corresponding to a second operating position for the tool;

an actuation mechanism for moving the tool between the first and second operating positions, the actuation mechanism comprising a seat associated with the piston sleeve to catch and release a plug, the seat being retained within an expansion chamber and formed of a plurality of separate arcuate segments which define an annular seat having a central opening;

at least one of said arcuate segments of the seat has a larger interior diameter than at least another of said arcuate segments thereby allowing fluid to flow through the seat when a plug is seated on the seat;

wherein:

a) the actuation mechanism moves the tool from the first operating position to the second operating position by landing a first actuation plug onto the seat and thereafter varying fluid pressure within the flowbore of the housing; and b) the actuation mechanism moves the tool from the second operating position to the first operating position by landing a second actuation plug that is of a different size than the first actuation plug onto the seat and thereafter varying fluid pressure within the flowbore of the housing;

a first actuation plug; and a second actuation plug which is of a different size than the first actuation plug.

6. The tool of claim 5 wherein the actuation mechanism further comprises:

the expansion chamber is formed in the housing, the expansion chamber having a plurality of chamber portions of different diameters, wherein the central opening of the seat provides a first diameter when the seat resides within one of said plurality of chamber portions; and the central opening provides a second diameter when the seat resides within another of said chamber portions.

7. The tool of claim 6 wherein there are three chamber portions and wherein the central opening has a third diameter when the seat resides within a third chamber portion.

8. The tool of claim 7 further comprising a damping assembly for controlling velocity of relative axial movement of the piston sleeve with respect to the housing, the damping assembly comprising:

a damping chamber defined between the housing and the piston sleeve, the damping chamber being filled with a fluid;

a damping piston affixed to the piston sleeve and disposed within the damping chamber; and a restrictive orifice disposed through the piston to permit fluid to be transferred across the piston.

9. The tool of claim 5 further comprising an indexing mechanism that governs the axial position of the piston sleeve with respect to the housing.

10. A circulation valve tool for use in subterranean hydrocarbon production and comprising:

a housing defining an axial flowbore and having an outer lateral fluid port formed therein;

a piston sleeve axially moveably disposed within the flowbore and having an inner lateral fluid port, the piston sleeve being moveable between a first position corresponding to a first operating position for the tool, and a second position corresponding to a second operating position for the tool;

an actuation mechanism for moving the tool between the first and second operating position, the actuation mechanism comprising a seat associated with the piston sleeve, the seat comprising a plurality of separate arcuate segments which define an annular seat having a central opening;

at least one of said arcuate segments of the seat has a lamer interior diameter than at least another of said arcuate segments, thereby allowing fluid to flow through the seat when a plug is seated on the seat;

wherein the actuation mechanism moves the tool from the first operating position to the second operating position by landing a first actuation plug onto the seat and thereafter varying fluid pressure within the flowbore of the housing; and wherein the actuation mechanism moves the tool from the second operating position to the first operating position by landing a second actuation plug that is of a different size than the first actuation plug onto the seat and thereafter varying fluid pressure within the flowbore of the housing.

11. The tool of claim 10 wherein the actuation mechanism further comprises:

an expansion chamber formed in the housing, the expansion chamber having a plurality of chamber portions of different diameters, wherein the central opening of the seat provides a first diameter when the seat resides within one of said plurality of chamber portions; and the central opening has a second diameter which is larger than the first diameter when the seat resides within another of said chamber portions.

12. The tool of claim 10 wherein there are three chamber portions and wherein the central opening has a third diameter when the seat resides within a third chamber portion.

13. The tool of claim 10 further comprising an indexing mechanism that governs the axial position of the piston sleeve with respect to the housing.

14. The tool of claim 10 wherein the tool may be repeatedly cycled between the first and second operating positions.

* * * * *